US006795643B2

(12) United States Patent
Ito et al.

(10) Patent No.: US 6,795,643 B2
(45) Date of Patent: Sep. 21, 2004

(54) HYBRID HOTAIR HEATER

(75) Inventors: Keiichi Ito, Aichi-ken (JP); Yoshinori Fujisawa, Aichi-ken (JP); Yukihiko Shimonoma, Aichi-ken (JP); Yoshimune Yamada, Aichi-ken (JP)

(73) Assignee: Rinnai Corporation, Aichi-ken (JP)

( * ) Notice: Subject to any disclaimer, the term of this patent is extended or adjusted under 35 U.S.C. 154(b) by 0 days.

(21) Appl. No.: 10/726,640

(22) Filed: Dec. 4, 2003

(65) Prior Publication Data

US 2004/0109680 A1 Jun. 10, 2004

(30) Foreign Application Priority Data

Dec. 6, 2002 (JP) ..... 2002-354586

(51) Int. Cl.[7] ..... F24D 13/00
(52) U.S. Cl. ..... 392/307; 392/365
(58) Field of Search ..... 392/307, 360–369, 392/347; 219/476

(56) References Cited

U.S. PATENT DOCUMENTS 2,060,079 A * 11/1936 Hood ..... 126/92 AC
3,295,334 A * 1/1967 Hultgren ..... 62/148
5,937,139 A * 8/1999 Peterson ..... 392/307

FOREIGN PATENT DOCUMENTS

| | | | |
|---|---|---|---|
| AT | 272471 | * 7/1969 | ..... 392/307 |
| IT | 410260 | * 4/1947 | ..... 392/307 |
| JP | 58-184431 | * 10/1983 | ..... 392/307 |

* cited by examiner

*Primary Examiner*—John A. Jeffery
(74) *Attorney, Agent, or Firm*—Arent Fox

(57) ABSTRACT

When errors occurred that prevented operation of one heater unit in a conventional hybrid type hotair heater, the heating operation was continued by means of the other heater unit although the user could not immediately recognize that error thereby resulting in the possibility that the error condition might remain in the hotair heater. Therefore, an error detection means was installed in each gas and electric heater unit to detect errors that prevent heating operation in each of these heater units. When an error is detected in one heater unit during the heating operation by means of said error detection means, the heating operation of the device stops once. When the operation starts up again, the other heater unit, where said error did not occur, runs and the heating operation continues.

2 Claims, 4 Drawing Sheets

HYBRID HOTAIR HEATER

BACKGROUND OF THE INVENTION

1. Field of the Invention

The present invention relates to a hybrid hotair heater in which a gas heater and an electric heater are incorporated in one frame.

2. Description of the Related Art

Conventionally, in a hybrid hotair heater, a combustion heater portion and an electric heater portion are incorporated in a frame and an air blowing system is constituted of one air blowing fan, as described in, for example, Jpn. Pat. Appln. KOKAI Publication No. 1993-322312. In this configuration, if an abnormality such as fuel run-out occurs on the combustion heater portion when the combustion heater portion and the electric heater portion are being operated simultaneously for heating, only the electric heater portion is used to continue heating.

That is, in this heater, abnormality detection means such as a sensor is provided to detect fuel run-out of the combustion heater portion, so that if an abnormality of the combustion heater portion is detected by this abnormality detection means when the combustion and electric heater portions are being operated simultaneously or the combustion heater portion is being operated for heating, the combustion heater portion is stopped in operation to continue heating by use of only the electric heater portion, thereby providing user-friendliness.

However, in this heater described above, if an abnormality occurs on the combustion heater portion, the system is automatically switched to heating by use of only the electric heater portion, so that a user of an appliance cannot readily recognize occurrence of the abnormality on the combustion heater portion, thus leaving an abnormal condition as un-cleared, which is a problem. In this case, for example, a buzzer may be mounted to the appliance to generate warning sound. However, if a user is not present around the appliance, he cannot know the abnormality eventually. Some of such abnormalities that have occurred need to be recovered by an expert, so that preferably the user recognizes an abnormal condition early and takes measures to clear this abnormal condition for safety.

In view of the above, it is an object of the present invention to provide such a hybrid hotair heater that a user can readily recognize an abnormality, if having occurred on either one of heater portions during heating to inhibit its operation, to provide a high degree of safety and that an appliance can be used even before the abnormality is cleared, to provide a high degree of convenience.

SUMMARY OF THE INVENTION

To solve the above problem, a hybrid hotair heater according to the present invention comprises a frame which has first and second outlets formed in its front face and first and second inlets formed in its rear face and in which a gas heater portion constituted of a gas burner and a first air blowing fan arranged below this gas burner so as to mix combustion gas from the gas burner and air sucked through the first inlet in the frame and blast them out of the first outlet into a room and an electric heater portion constituted of an electric heater for heating air sucked in through the second inlet and a second air blowing fan for blasting the heated air out of the second outlet to the room are incorporated in such a manner that air blowing systems of these respective two heater portions may be independent of each other in partitioning, wherein each of the gas and electric heater portions is provided with abnormality detection means for detecting an abnormality which inhibits heating by each of the heater portions, so that if an abnormality of one of the heater portions is detected by the abnormality detection means during heating, heating of an appliance is stopped once to operate the other heater portion free of the abnormality for restarting of heating.

According to the present invention, if an abnormality which inhibits operation of one of the heater portions is detected by the abnormality detection means, heating is once stopped thoroughly irrespective of conditions of heating by the heater portions. Therefore, a user can early recognize occurrence of some abnormality on the appliance because heating is stopped and so can take measure to clear this abnormal condition early, thereby providing a high degree of safety. Then, after the user recognizes the abnormality and instructs for restarting of operation, the other heater portion free of the abnormality is operated for heating. Therefore, even in a condition where one of the heater portions has an abnormality, the other heater portion which is normal can be operated for heating, thus providing user-friendliness. It is to be noted that the abnormality detection means may preferably be a temperature sensor for preventing, for example, overheating of the appliance.

As described above, in a hybrid hotair heater according to the present invention, if an abnormality occurs on one of heaters which inhibits its operation during heating, a user can readily recognize the abnormality to provide a high degree of safety and, furthermore, can use an appliance even before the abnormality is cleared, to provide a high degree of convenience.

DESCRIPTION OF THE PREFERRED EMBODIMENTS

Figure 1:
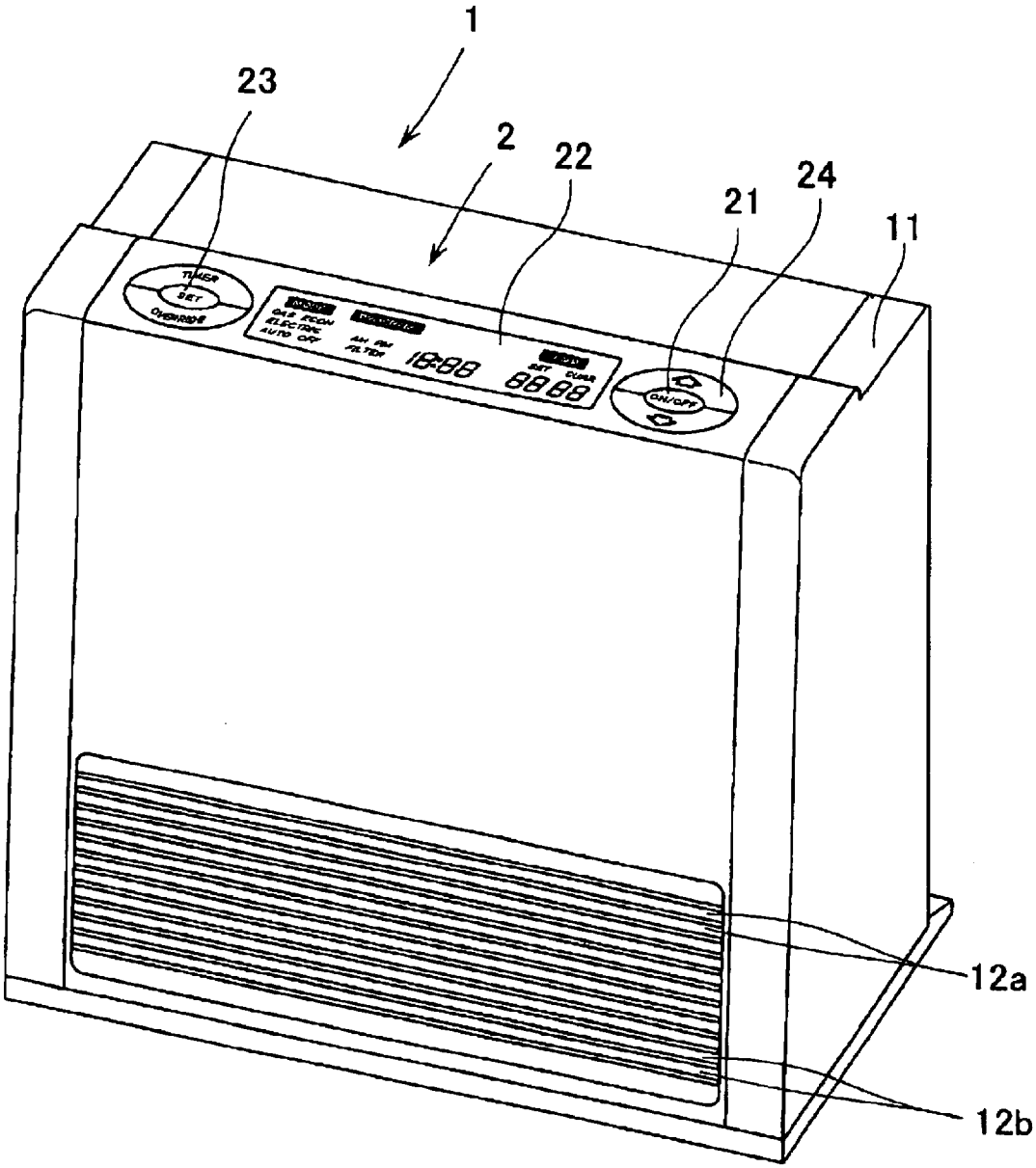
FIG. 1 is a perspective view of a hybrid hotair heater according to the present invention.
Figure 2:
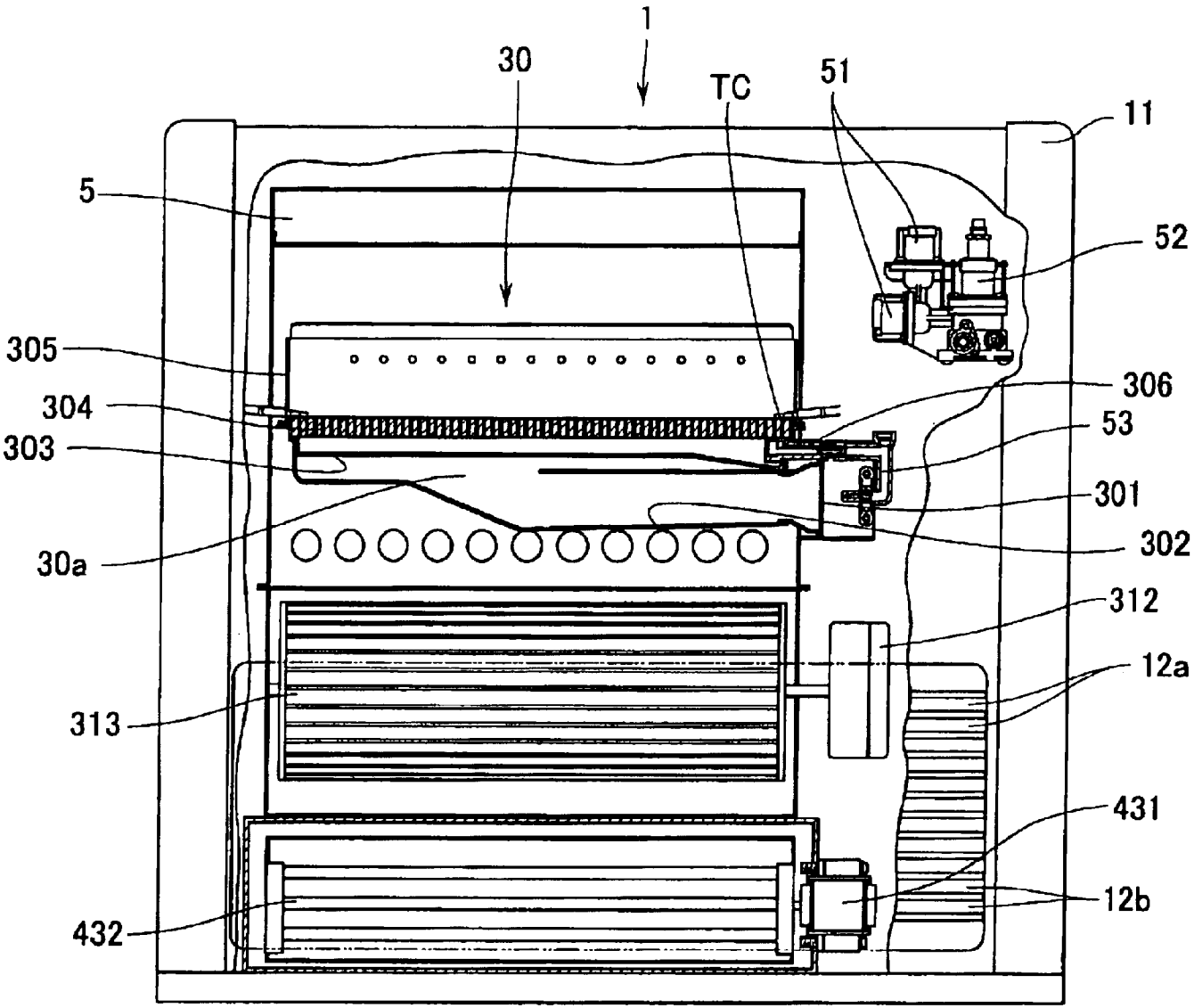
FIG. 2 is an explanatory plan view of a configuration of the hybrid hotair heater according to the present invention.
Figure 3:
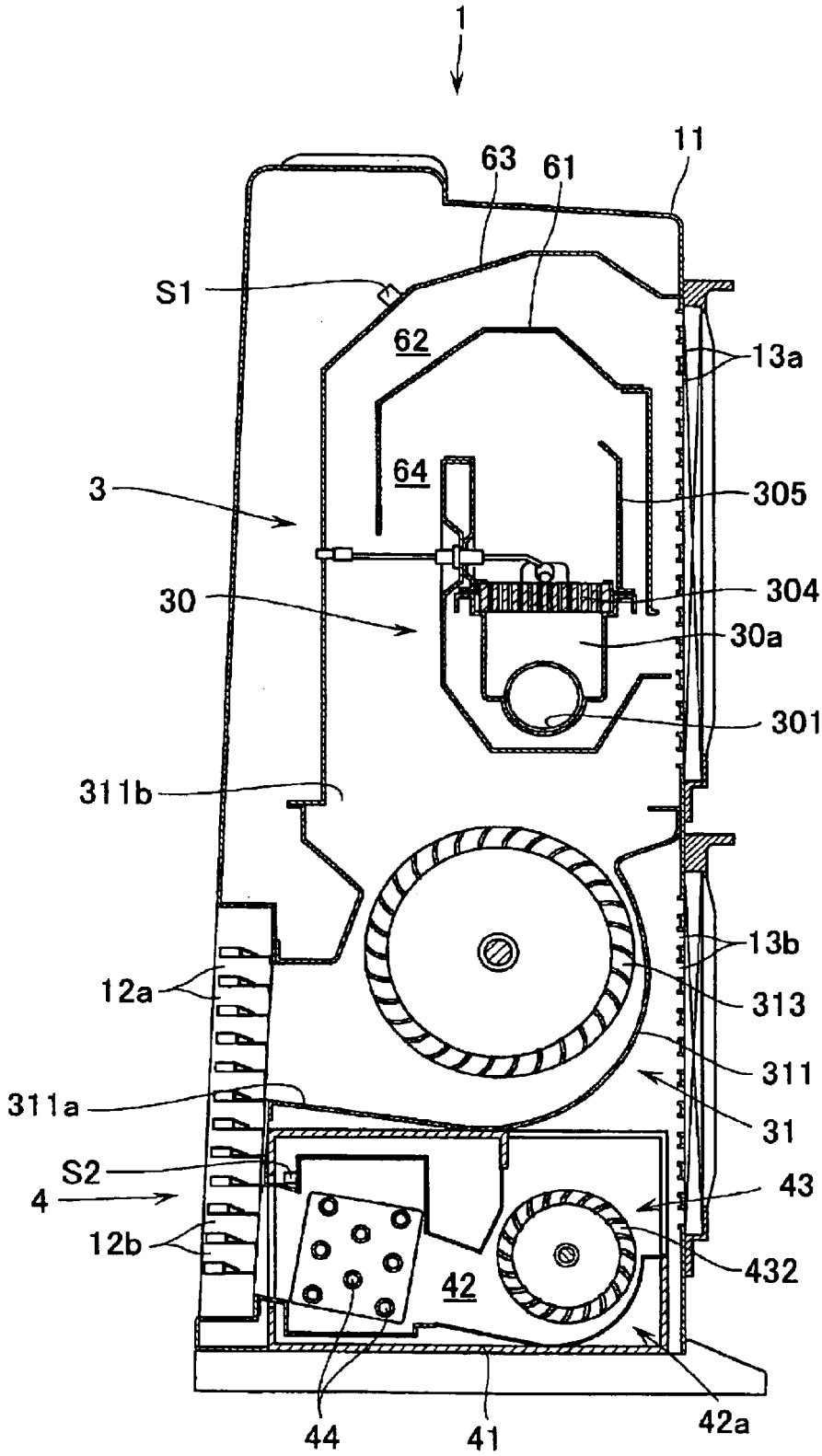
FIG. 3 is an explanatory vertical cross-sectional view of the configuration of the hybrid hotair heater according to the present invention.

In FIGS. 1–3, a reference numeral 1 indicates a hybrid hotair heater according to the present invention. This hotair heater (hereinafter referred to as "appliance") 1 has a box-shaped frame 11. The frame 11 is provided on its upper face with an operation portion 2 for controlling heating of the appliance 1. This operation portion 2 comprises a driving switch 21, a display 22 for displaying set temperature and time, a driving mode setting switch 23 for instructing a microcomputer (not shown) provided in the appliance to make predetermined setting, and setting changing switches 24 disposed above and below the driving switch 21 respectively. In the frame 11, there are incorporated a gas heater portion 3 on an upper side and an electric heater portion 4 on a lower side. A first outlet 12*a* and a second outlet 12*b* are formed in a front face of the frame 11 and a first inlet 13*a* and a second inlet 13*b* are formed in a rear face of the frame 11 to face the gas heater portion 3 and the electric heater portion 3 respectively so that, as described later, two air blowing fans may be used to make an air blowing system of the gas heater portion 3 and that of the electric heater portion 4 independent of each other.

The gas heater portion 3 comprises a main gas burner 30 and a first air blowing fan 31 which is arranged below the main gas burner 30 and which supplies the main gas burner 30 with combustion air and mixes combustion gas from this main gas burner 30 with air sucked through the first inlet 13*a* in the frame 11 to blast them out to a room. The main gas burner 30 is an all primary air combustion plate burner and has a burner body 30*a* in which there are formed a fuel/air inlet 301 faced by a gas nozzle 53 mounted to a tip of a gas tube (not shown) connected with an electromagnetic safety valve 51 and a proportional control valve 52 which are arranged in the frame 11 and a mixer tube portion 302 communicating with this inlet 301. On an open upper face of the burner body 30*a*, a ceramic combustion plate 304 having a plurality of flame ports provided therein in a row is mounted via a distribution plate 303. This main gas burner 30 is contained in a combustion chamber 305.

The burner body 30*a* is provided also with an oxygen-deficiency detection burner 306 arranged below the combustion plate 304. This oxygen-deficiency detection burner 306 is a small-sized gas burner which requires secondary air and which is combined with a thermocouple TC arranged above the combustion plate 304 to constitute oxygen-deficiency detection means which serves as a safety device for countermeasure against oxygen deficiency. In this case, the electromagnetic safety valve 51 is opened and held as it is based on electromotive force from the thermocouple TC. Therefore, if the electromotive force falls below a predetermined voltage owing to unstable combustion of the oxygen-deficiency detection burner 306 caused by oxygen deficiency, the electromagnetic safety valve 51 is closed to stop unstable combustion of the main gas burner 30 owing to insufficient primary air.

In the frame 11, there is also provided a diversion plate 61 in such a manner as to surround an upper side of the combustion chamber 305 and so that when the first air blowing fan 31 described later is operated, air sucked through the first inlet 13*a* in the frame 11 and combustion gas from the combustion chamber 305 may be partitioned from each other until they flow by a predetermined distance. In the frame 11, there is provided a partition 63 in such a manner as to cover this diversion plate 61 and so that an air passage 62 may be formed to lead to the first air blowing fan 31 between itself and the diversion plate 61. On an outer wall face of this partition 63, there is provided a temperature sensor S1 which is constituted of, for example, a thermistor and serves as abnormality detection means to detect abnormal overheating of the gas heater portion 3. If a temperature detected by this temperature sensor S1 exceeds a predetermined temperature, heating by the gas heater portion 3 is stopped.

The air blowing fan 31 arranged below the burner body 30*a* has a housing 311 in which a air blowing duct 311*a* leading to the first outlet 12*a* is formed. In the housing 311, there is arranged a cross-flow type first moving vane 313 connected to a first motor 312 whose rotation speed can be controlled. In this case, the air passage 62 and an internal space of the housing 311 communicate with each other through an upper-face opening 311*b* in the housing 311.

In such a manner, an air blowing system of the gas heater portion 3 leading from the first inlet 13*a* to the first outlet 12*a* is formed. In this configuration, when the first motor 312 is driven to rotate the first moving vane 313, air in the room is sucked through the inlet 13*a* in the frame 11, so that the air is supplied to the inlet 301 in the burner body 30*a* and flows through the air passage 62. In this case, if fuel gas is sprayed through the gas nozzle 53 to the inlet 301, an air-fuel mixture is supplied to the combustion plate 304. It is to be noted that an air/fuel ratio is adjusted by controlling the first motor 312 to control a rotation speed of the first moving vane 313. Combustion gas from the combustion chamber 305 passes through a combustion gas passage 64 on an inner side of the diversion plate 61 and is sucked toward the first air blowing fan 31. Air sucked through the first inlet 13*a* passes through the air passage 62 and undergoes heat exchange through the diversion plate 61 and then is mixed with the combustion gas at a downstream-side end of this diversion plate 61 to be cooled and flow through the opening 311*b* into the housing 311. Then, hotair is released through the outlet 12*a* to the room.

On the other hand, the electric heater portion 4 is contained in a case 41 made of resin and has an air blowing passage 42 leading from the second inlet 13*b* to the second outlet 12*b*. In this case, to miniaturize the electric heater portion 4, the air blowing passage 42 is formed as bent in a direction from an upper side of the appliance 1 to a horizontal side. A bent portion 42*a* obtained by thus bending this air blowing passage 42 is provided with a second air blowing fan 43. The second air blowing fan 43 comprises a second motor 431 whose rotation speed can be controlled and a cross-flow type second moving vane 432 connected to this second motor 431 and arranged on the bent portion 42*a*. On a downstream side of this bent portion 42*a*, there are provided eight sheathed heaters 44. Further, on an outer wall face of the air blowing passage 42, there is provided a temperature sensor S2 which is constituted of, for example, a thermistor and serves as abnormality detection means to detect abnormal overheating of the electric heater portion 4. If a temperature detected by this temperature sensor S2 exceeds a predetermined temperature, heating by the electric heater portion 4 is stopped.

In such a manner, an air blowing system of the electric heater portion 4 leading from the second inlet 13*b* to the second outlet 12*b* is formed. If, in this configuration, the second motor 431 is driven to rotate the second moving vane 432, air in the room is sucked through the second inlet 13*b* in the air blowing passage 42 and heated while it passes around the sheathed heaters 44 and then is released through the second outlet 12*b* to the room as hotair. It is to be noted that the first and second outlets 12*a* and 12*b* are formed adjacent to each other so that hotair blasted out of the first air blowing fan 31 and hotair blasted out of the second air blowing fan 43 may flow into each other.

Figure 4:
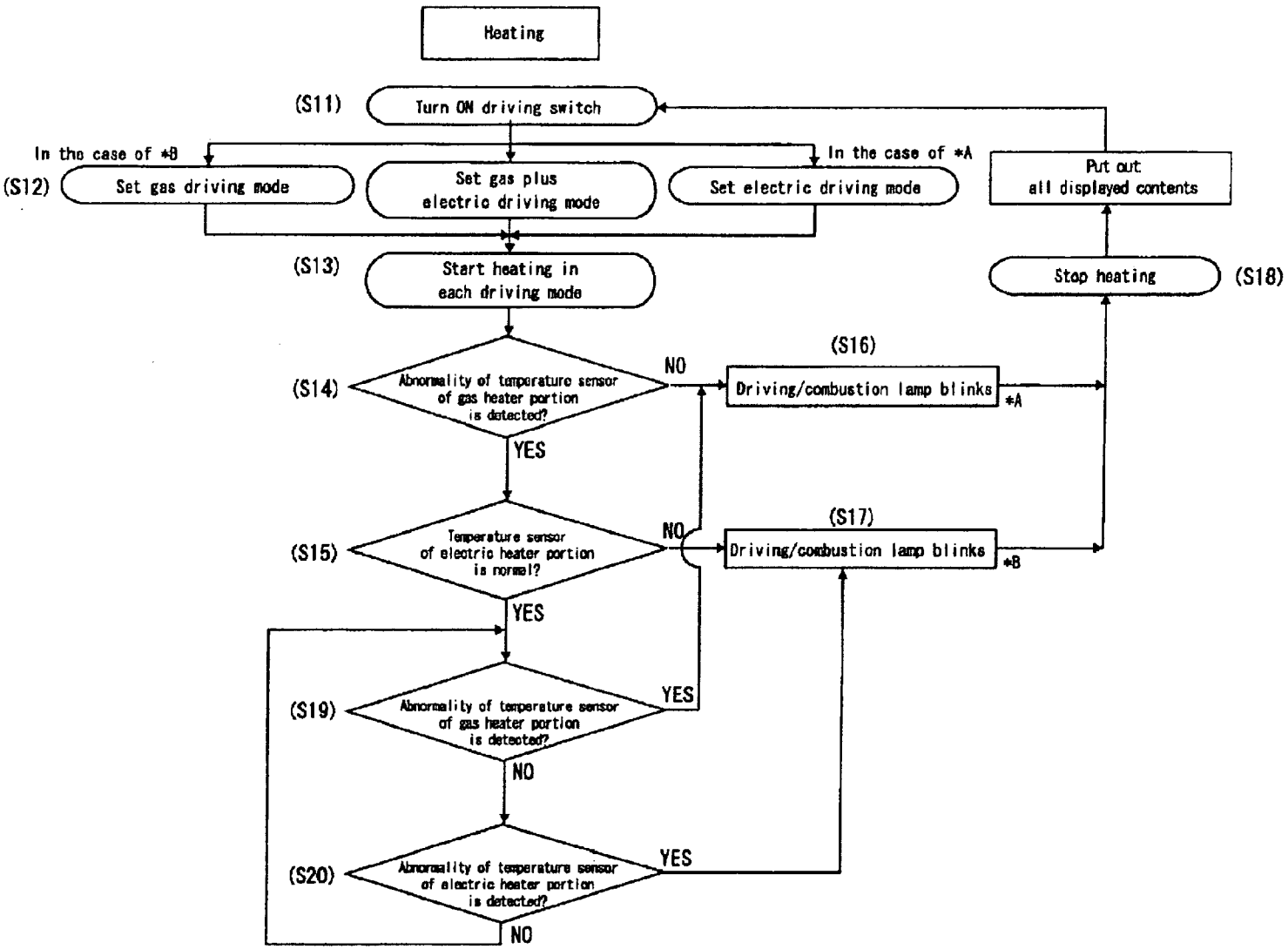
FIG. 4 is an explanatory flowchart of operations of the hybrid hotair heater according to the present invention.

Next, how to heat this appliance 1 is described with reference to FIGS. 1 and 4. When the driving switch 21 is turned ON in a condition where the appliance 1 is at rest (S11), settings stored in a control unit when this appliance 1 is stopped in heating last time are displayed on the display 22, whereupon heating starts under the settings. In this case, the driving mode setting switch 23 can be pressed to change a heating mode (S12) or the setting changing switch 24 can be pressed to change a set temperature. In the present embodiment, the driving mode can be selected from three modes where only the gas heater portion 3 is operated, where only the electric heater portion 4 is operated, and where the gas heater portion 3 and the electric heater portion 4 are operated simultaneously. If the settings are thus changed as desired, the process heats the appliance in the corresponding driving mode (S13). Next, the process decides whether the temperature sensors S1 and S2 of the respective heater portions 3 and 4 are normal in operation (S14, S15). If the temperature sensor S1 or S2 is faulty owing to disconnection etc., the process blinks a driving/combustion lamp for the heater 3 or 4 displayed on the display 22 (S16, S17), thus stopping heating (S18).

Next, if, after the temperature sensors S1 and S2 are decided to be normal, the process detects an abnormality which inhibits heating by the heater portion 3 or 4 such as overheating (S19, S20) of the heater portion 3 or 4 detected by the temperature sensor S1 or S2 respectively, the process blinks the driving/combustion lamp for the heater portion 3 or 4 displayed on the display 22, thus once stopping heating of the appliance 1 thoroughly (S18). It is to be noted that some of such abnormalities that have occurred on the appliance 1 need to be recovered by an expert, so that in such a case, if the appliance 1 cannot be used at all until they are recovered, it is inconvenient for the user.

In the present embodiment, if the driving switch 21 is turned ON again in a condition where either one of the heater portions 3 and 4 is abnormal, the process automatically puts in the driving mode either one of the gas heater and electric heater portions 3 and 4 that is free of an abnormality and normal in operation so as to heat the appliance by use of it (for example, if an abnormality detected by the temperature sensor S1 of the gas heater portion 3 (S19) is yet to be cleared when heating is restarted, the process puts the electric heater portion 4 in the heating mode (in the case of *A).

Therefore, a user can early recognize occurrence of some abnormality on the appliance 1 because heating is stopped and so can take measure to clear this abnormal condition early, thereby providing a high degree of safety. Then, after the user recognizes the abnormality and instructs for restarting of operation, either the gas heater portion 3 or the electric heater portion 4 that is free of the abnormality is operated for heating, thus providing user-friendliness. Further, since the gas heater portion 3 or the electric heater portion 4 that is normal in operation is automatically put in the driving mode when the heating is restarted, the heater portion 3 or 4 that has an abnormality can be avoided from being operated mistakenly, thus improving a degree of safety of the appliance 1 itself.

Although the present embodiment has been described with reference to a case where an abnormality is detected by the temperature sensor S1 or S2 for preventing overheating of the heater portion 3 or 4, the abnormality detection means is not limited to them; for example, any abnormality means may be employed as far as it can detect an abnormality that inhibits heating by any one of the heater portions 3 and 4. This abnormality detection means may be, for example, the above-mentioned oxygen-deficiency detection means or disconnection detection means for detection disconnection of the electric heater.

What is claimed is:

1. A hybrid hotair heater comprising a frame which has first and second outlets formed in its front face and first and second inlets formed in its rear face and in which a gas heater portion constituted of a gas burner and a first air blowing fan arranged below said gas burner so as to mix combustion gas from said gas burner and air sucked through said first inlet in said frame and blast them out of said first outlet into a room and an electric heater portion constituted of an electric heater for heating air sucked in through said second inlet and a second air blowing fan for blasting said heated air out of said second outlet to said room are incorporated in such a manner that air blowing systems of said two heater portions may be independent of each other in partitioning, wherein each of said gas and electric heater portions is provided with abnormality detection means for detecting an abnormality which inhibits heating by each of said heater portions, so that if an abnormality of one of said heater portions is detected by said abnormality detection means during heating, heating of an appliance is stopped once to operate the other heater portion free of said abnormality for restarting of heating.

2. The hybrid hotair heater according to claim 1, wherein said abnormality detection means is a temperature sensor for preventing said appliance from being overheated.

* * * * *